US012599831B2

(12) United States Patent
Fan

(10) Patent No.: US 12,599,831 B2
(45) Date of Patent: Apr. 14, 2026

(54) MULTI-FUNCTIONAL STORAGE BOX FOR GOLF

(71) Applicant: Eagle Fan, Chu-Pei City (TW)

(72) Inventor: Eagle Fan, Chu-Pei City (TW)

( * ) Notice: Subject to any disclaimer, the term of this patent is extended or adjusted under 35 U.S.C. 154(b) by 764 days.

(21) Appl. No.: 18/095,133

(22) Filed: Jan. 10, 2023

(65) Prior Publication Data

US 2024/0226698 A1 Jul. 11, 2024

(51) Int. Cl.

| | |
|---|---|
| ***A63B 71/00*** | (2006.01) |
| ***A63B 45/02*** | (2006.01) |
| ***A63B 57/00*** | (2015.01) |
| ***A63B 69/36*** | (2006.01) |
| ***B65D 43/22*** | (2006.01) |
| ***B65D 51/24*** | (2006.01) |

(52) U.S. Cl.

CPC ..... *A63B 71/0036* (2013.01); *A63B 45/02* (2013.01); *A63B 69/3676* (2013.01); *B65D 43/22* (2013.01); *B65D 51/24* (2013.01); *A63B 57/00* (2013.01)

(58) Field of Classification Search

CPC . A63B 71/0036; A63B 45/02; A63B 69/3676; A63B 57/00; B65D 43/22; B65D 51/24

See application file for complete search history.

(56) References Cited

U.S. PATENT DOCUMENTS 6,398,661 B1 * 6/2002 Llewellyn ..... A63B 57/357 473/180

2007/0205553 A1 * 9/2007 Turley ..... A63F 7/0628 273/108.2

FOREIGN PATENT DOCUMENTS

KR 20250000655 U * 4/2025 ..... B65D 81/36

OTHER PUBLICATIONS

Translation of KR20250000655. (Year: 2025).*

* cited by examiner

*Primary Examiner* — Jeffrey S Vanderveen

(57) ABSTRACT

A multi-functional storage box for golf is provided, comprising: a storage box and a foldable stick, the storage box comprising a box and a cover for opening and closing the case, one end of the foldable stick pivotally connected to the cover, the foldable stick being foldable into an inverted U-shaped gate standing adjacent to the cover; the cover having at least a line-drawing portion, and the line-drawing portion having an arc-shaped wall and at least a line. As such, in addition to storing items, the storage box can assist in drawing lines on the surface of the golf ball for marking, and the foldable stick can be bent into a gate shape, used as a putter by the golf ball For aiming purposes.

10 Claims, 6 Drawing Sheets

MULTI-FUNCTIONAL STORAGE BOX FOR GOLF

BACKGROUND OF THE INVENTION

1. Field of the Invention

The present invention relates generally to a storage box, and more particularly, to a multi-functional storage box for golf.

2. The Prior Arts

In golf, large clubs and golf balls in large volume are directly placed in the ball bag, which is convenient to carry and walk after hitting the ball. However, there are some small accessories necessary in sports, such as tees, divot tool and ball markers, pencils, etc., the storage box is generally used to collect the aforementioned small items before putting in the ball bag to avoid the debris and scattering inside the ball bag. In addition, some people will mark the surface of the golf ball with an oil-based pen to make it easier to confirm the direction of rotation of the ball after hitting the ball, and then correct the hitting posture or direction of the ball, or use other aids to assist when drawing the line; therefore, more and more accessories are added into the ball bag.

The most important thing in putting is the ability to correctly push the golf ball to the predetermined location, through a lot of practice to maintain the consistency of the swing posture, learn to control the power of the putter, and then control the rolling speed and direction of the golf ball, so that the player can easily hit the ball to the target point anytime, anywhere, develop firm self-confidence, and avoid the stiff muscles due to tension during the game, resulting in mistakes. For this reason, there is a need for devices and facilities that are simple, effective, and convenient to use at any time, so that the practitioner can perform the above-mentioned putting technique any time, whether in the indoor driving range or on the outdoor grass, and concentrate on training to adapt to reality. The ability of the grass environment, thereby improving the accuracy of putting. Therefore, through continuous thinking and improvement, the multi-purpose storage box is provided.

SUMMARY OF THE INVENTION

A primary objective of the present invention is to provide a multi-functional storage box for golf, in addition to accommodating small accessories used for golf, also able to be used to draw lines on the surface of the golf ball for marking, or as a gate in putting practice.

For the aforementioned objective, the present invention provides a multi-functional storage box for golf, including: a storage box and a foldable stick, the storage box includes a box and a cover able to open and close the box, one end of the foldable stick being pivotally connected to the cover, and the foldable stick being bent to form an inverted U-shaped gate standing adjacent to the cover; the cover having at least one line-drawing portion, and the line-drawing portion comprising an arc-shaped wall and at least a line running through the arc-shaped wall.

In a preferred embodiment, a surface of the cover has a strip-shaped storage groove, one end of the storage groove is located at where the foldable stick is pivotally connected to the cover, and the storage groove is for accommodating the foldable stick when the foldable stick is in a straight line shape.

In a preferred embodiment, the foldable stick comprises at least three sticks connected in sequence and can rotate at connecting joints.

In a preferred embodiment, the foldable stick comprises a first stick, a second stick, and a third stick, and the size of the second stick is the same as the target hole of the golf ball, and the first stick and the third stick are respectively pivotally connected by two ends of the second stick.

In a preferred embodiment, at least one recessed area is formed in a specific area of the cover, and the line-drawing portion is located in the recessed area.

In a preferred embodiment, there are three lines and the three lines are parallel to one another.

In a preferred embodiment, the line is a cross-shaped slot.

Another embodiment of the present invention is a multi-functional storage box for golf, including: a storage box and a foldable stick, the storage box comprising a box and a cover for opening and closing the box, one end of the foldable stick being pivotally connected to the cover, the foldable stick comprising at least three sticks connected in sequence and rotatable at connecting joints, the foldable stick being foldable to form an inverted U-shaped gate standing adjacent to the cover.

The multi-functional storage box for golf of the present invention, compared with conventional technology, can accommodate golf tees, tees, divot tool and ball markers, pencils, oil-based pens, etc. or other small articles in the storage box, the line-drawing portion, through an oil-based pen, can be used to draw lines on the surface of the golf ball for marking. The foldable stick can be folded into a gate shape and can be used as the aiming target for putting practice. After hitting the ball, the marking on the golf ball surface can also be used to confirm the rotation direction of the ball, for calibrating the hitting posture or hitting direction. Therefore, the present invention achieves the objective as a multi-purpose storage box.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

The accompanying drawings are included to provide a further understanding of the invention, and are incorporated in and constitute a part of this specification. The drawings illustrate embodiments of the invention and, together with the description, serve to explain the principles of the invention.

Figure 1:
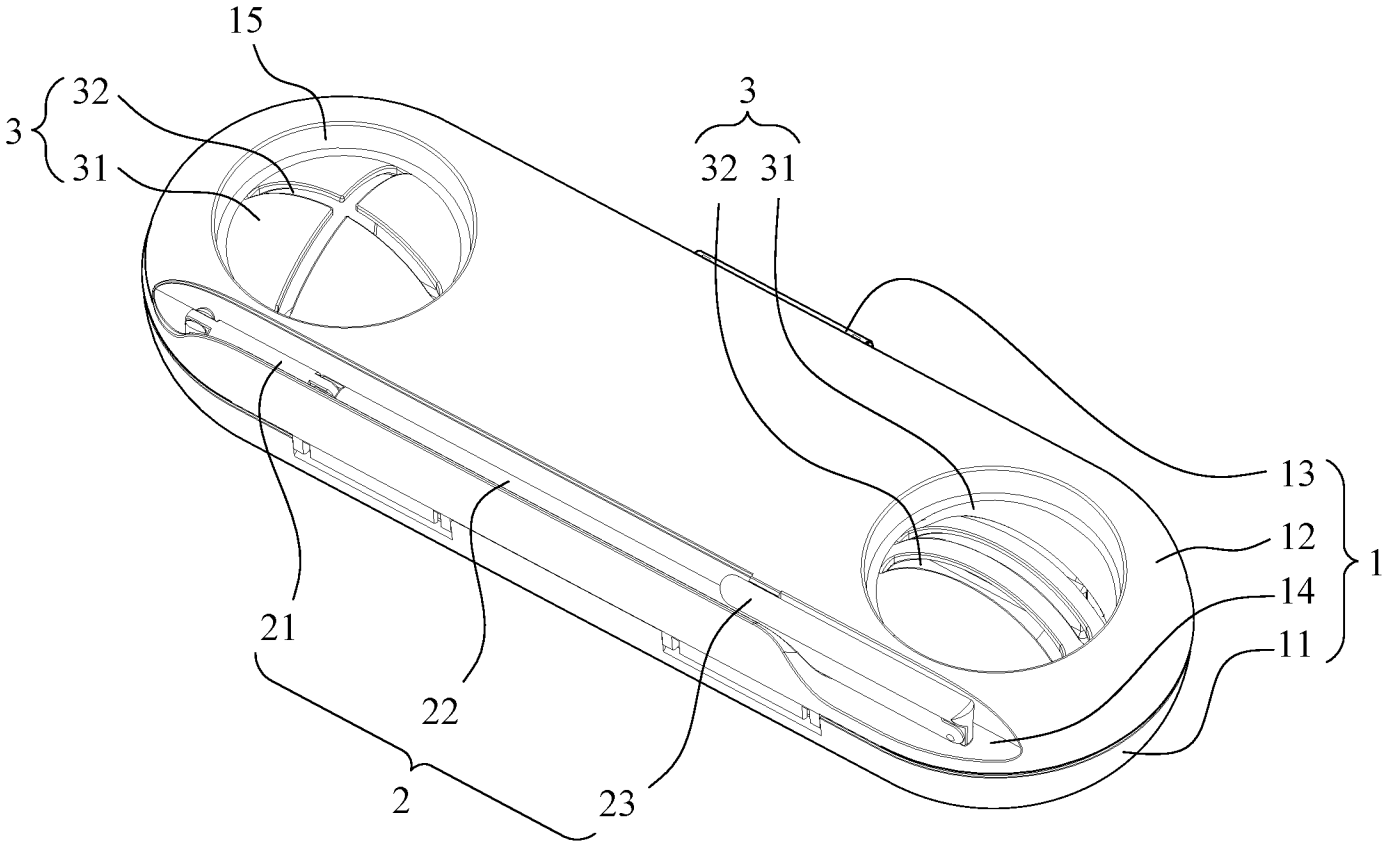
FIG. 1 is a perspective view of the present invention.
Figure 2:
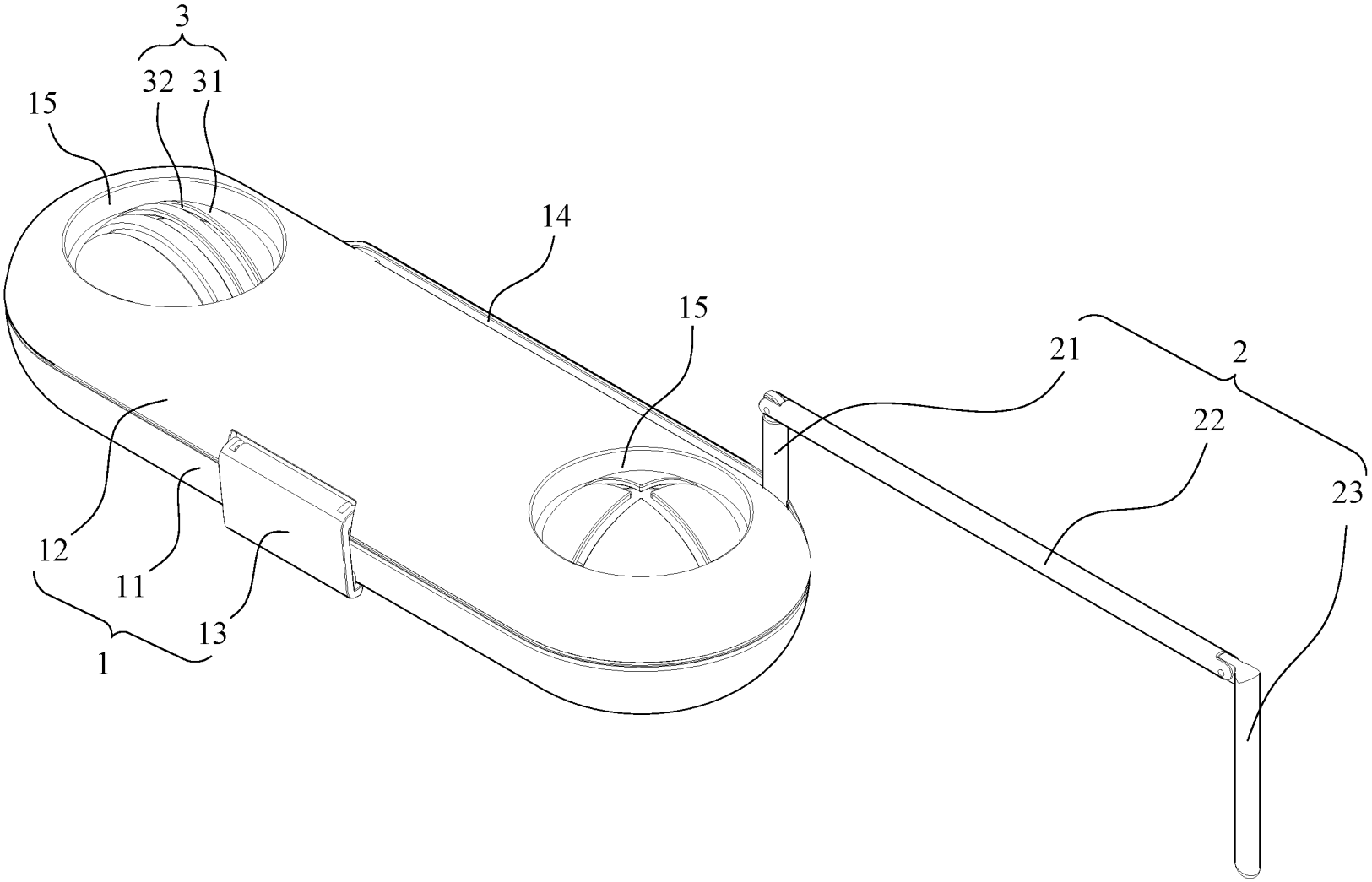
FIG. 2 is a schematic view of the use of the present invention.

As shown in FIG. 1 and FIG. 2, the present invention is a multi-functional storage box for golf, including: a storage box 1 and a foldable stick 2. The storage box 1 further includes a box 11 and a cover 12, and the cover is used to open or close the box 11. One end of the foldable stick 2 is pivotally connected to the cover 12. After folding, the foldable stick 2 can form an inverted U-shaped gate to be standing adjacent to the cover 12. The cover 12 has at least one line-drawing portion 3. The line-drawing portion 3 includes an arc-shaped wall 31 and at least a line 32 passing through the arc-shaped wall 31. As such, the interior space of the storage box 1 can be used for putting golf tees, divot tools and markers, pencils, oil-based pens, or other small items. With the line-drawing portion 3, lines can be easily drawn on the surface of the golf ball for marking, which is convenient for marking on the surface of the golf ball for confirming the rotation direction of the ball after hitting the ball, and then for calibrating the hitting posture or direction. The foldable stick 2, after folding into a gate shape, can be used as the aiming target for putting practice.

Figure 3:
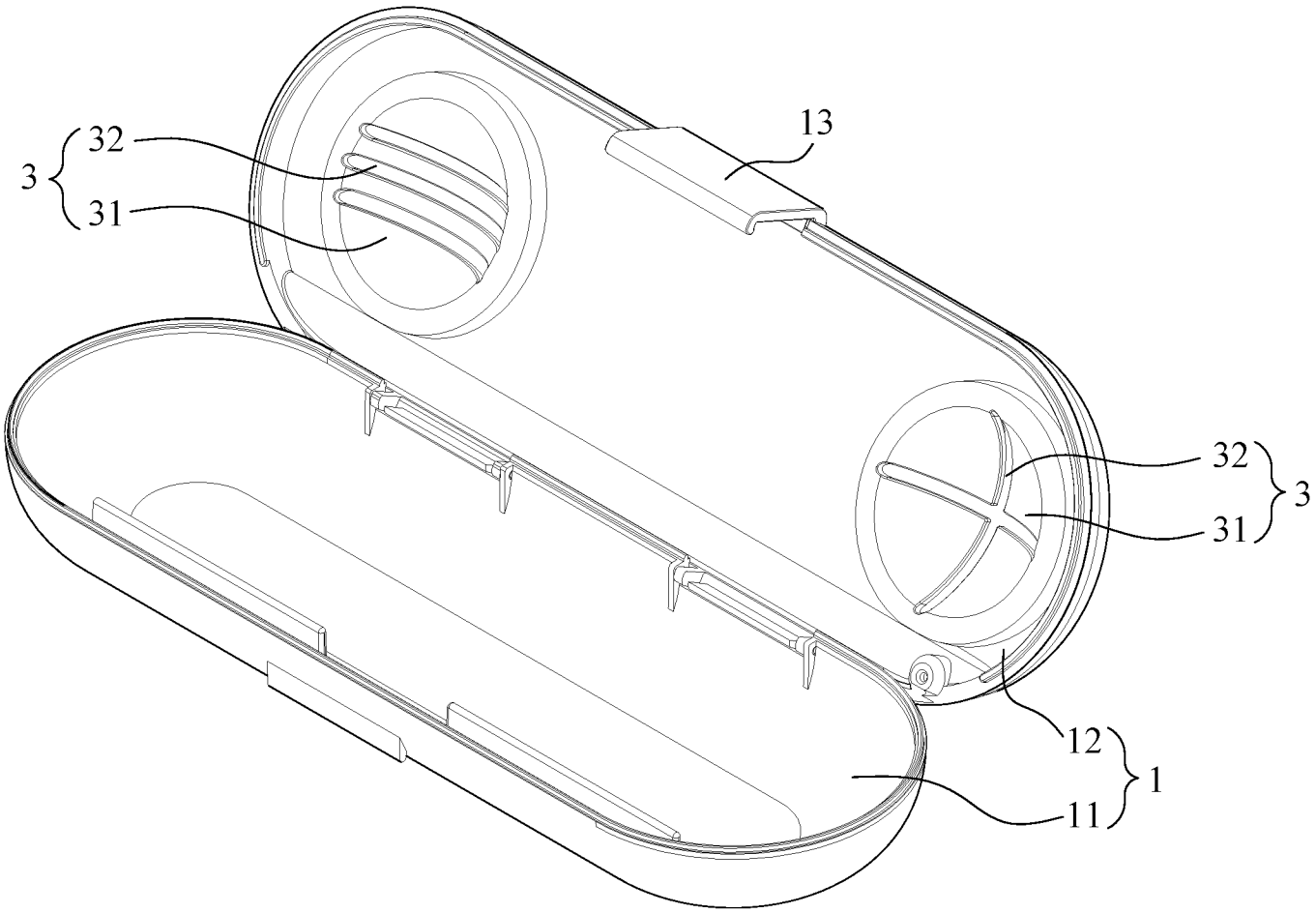
FIG. 3 is a schematic view of the internal structure of the storage box of the present invention after opening.

The following describes each component in detail, and also refer to FIG. 3:

The storage box 1 is a hollow elongated container, including the box 11 and the cover 12 that can open and close the box 11. In the present embodiment, the cover 12 is pivotally connected to the long side of the box 11, to open or close the box 11. In other embodiment, the cover 12 can also be combined with the box 11 by a flexible connector, such as soft leather, soft bent sheet, etc., so as to facilitate opening or closing. Alternatively, the cover 12 and the box 11 can be separable, and are docked and fixed together when combined. Therefore, the type of the storage box 1 is not limited to thereto. In the present embodiment, the cover 12 is also provided with a rotatable fastener 13. After the cover 12 is closed on the box 11, the fastener 13 is pulled to engage with a specific position of the box 11, so that the box 11 and the cover 12 are fixed together to prevent the box from opening accidentally and the stored items are scattered.

One end of the foldable stick 2 is pivotally connected to the cover 12. The foldable stick 2 includes at least three sticks connected in sequence and can rotate at the connecting joints. In the present embodiment, the foldable stick 2 includes a first stick 21, a second stick 22, and a third stick 23. The size of the second stick 22 is close to the target hole of a golf court, and the two ends of the second stick 22 are respectively pivoted connected to the first stick 21 and the third stick 23. The first stick 21 is pivotally connected to the cover 12. As shown in FIG. 2, after the foldable stick 2 is bent, the first stick 21, the second stick 22, and the third stick 23 form an inverted U-shaped gate to stand adjacent to the cover 12. In addition, the surface of the cover 12 has an elongated storage groove 14, and one end of the storage groove 14 is located at where the foldable stick 2 is pivotally connected to the cover 12, as shown in FIG. 1. The storage groove 14 can accommodate the foldable stick 2 when the foldable stick 2 is unfolded to become a straight stick.

Figure 4:
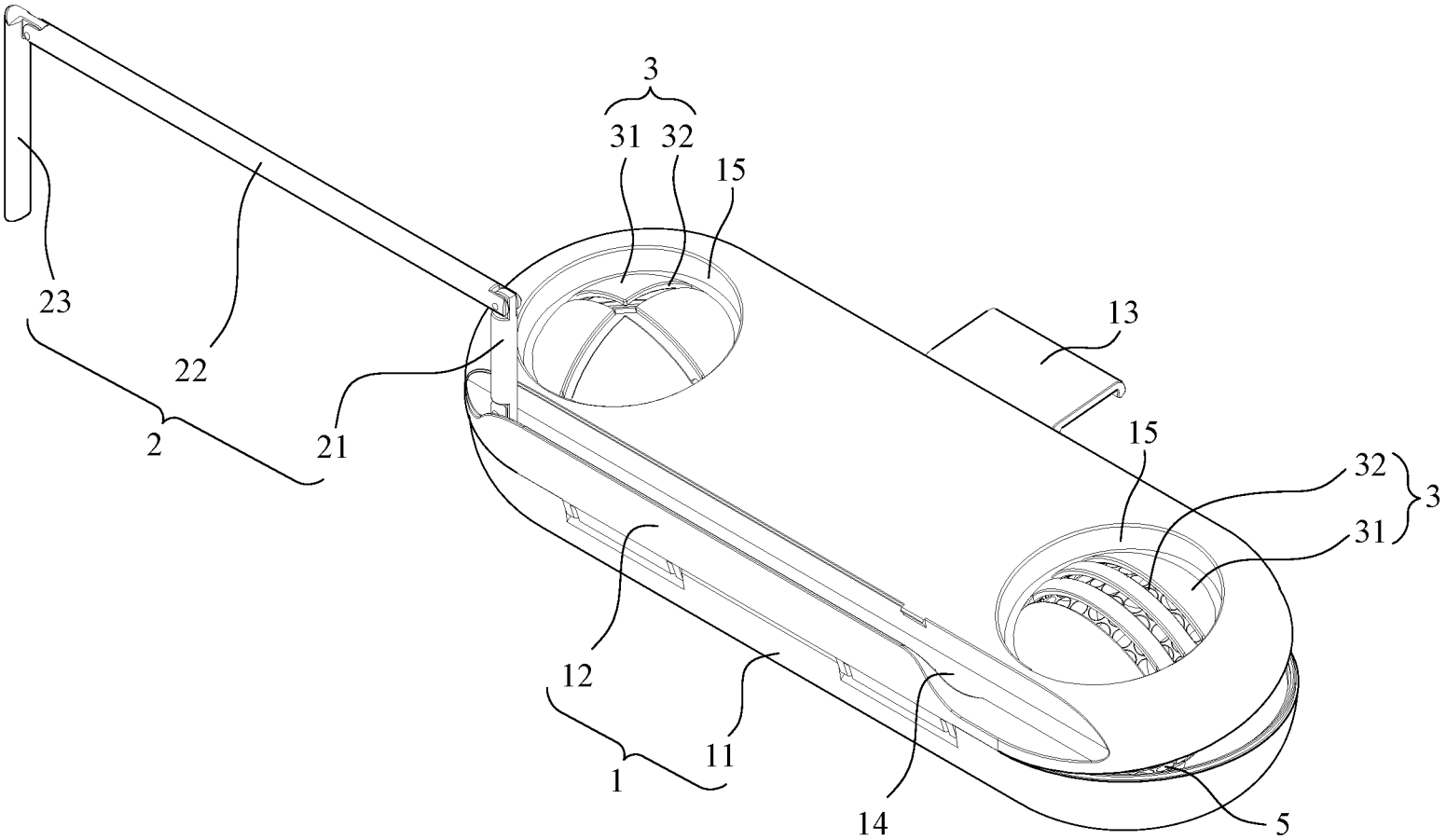
FIG. 4 is a schematic view of restricting the golf ball to the storage box of the present invention.

An area on the cover 12 has at least a line-drawing portion 3, the line-drawing portion 3 includes an arc-shaped wall 31 and at least a line 32 passing through the arc-shaped wall 31. As shown in FIG. 3, the inner side of the arc-shaped wall 31 is an arc surface. In order to contact with the golf ball 5, as shown in FIG. 4, the golf ball 5 is restricted at a position when the cover 12 close down on the box 11. The line 12 is for the oil-based pen to draw from outside on the surface of the golf ball 5 to form required markings. In the present embodiment, there are two line-drawing portions 3 distributed on the cover 12. The shapes of the two line-drawing portions 3 are different. One is formed by three parallel lines 32, and the other has the line 32 in a shape of a cross-shaped slot, so that the user can freely draw desired markings on the surface of the golf ball 5 according to the needs. In addition, in order not to interfere with the operation of the structure of the storage groove 14, at least one recessed area 15 is formed in a specific area of the cover 12, and the line-drawing portion 3 is located in the recessed area 15.

Figure 5:
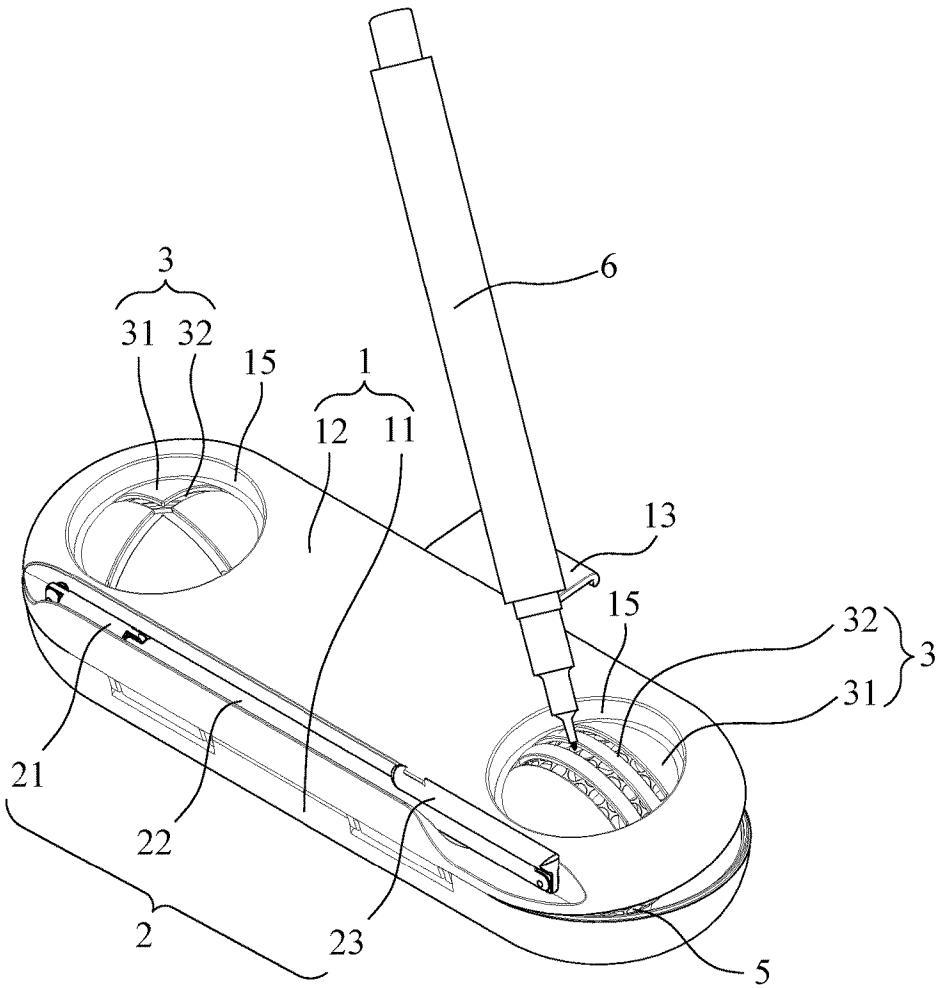
FIG. 5 is a schematic view of drawing a golf ball in the present invention.
Figure 6:
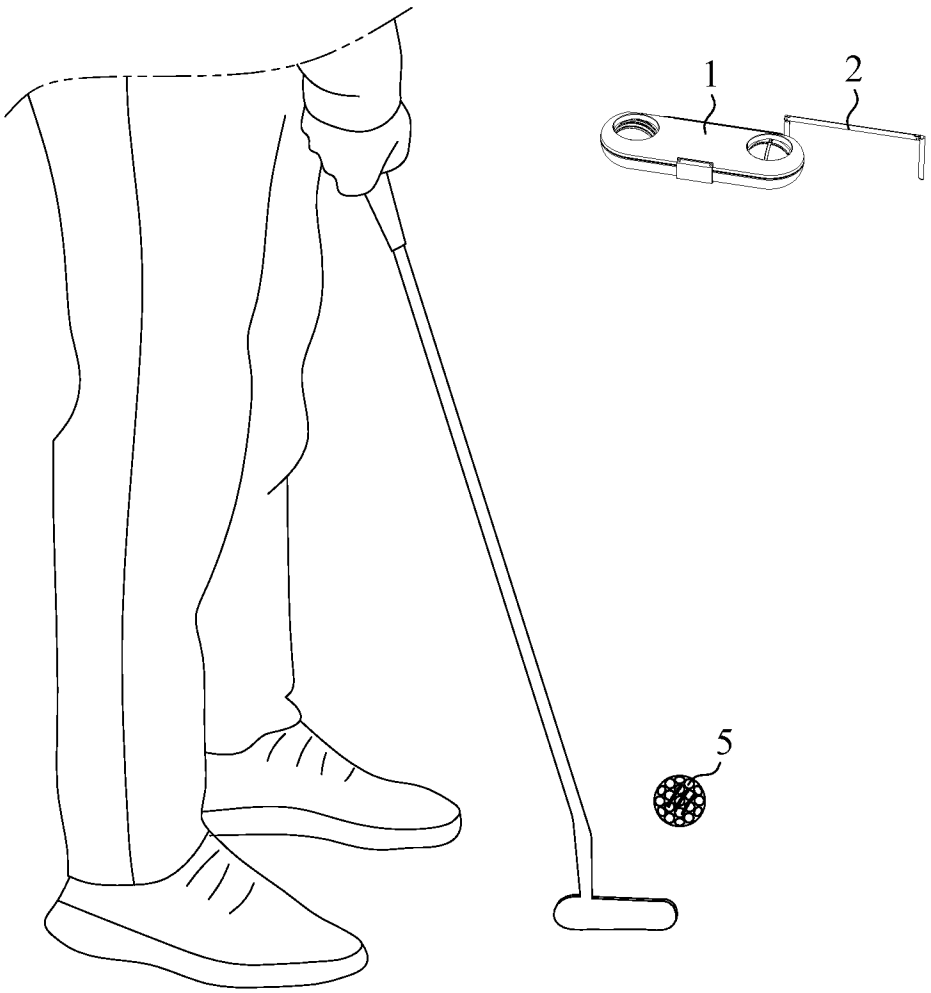
FIG. 6 is a schematic view of the usage state of golf putting practice with the present invention.

The following describes the operation of the present invention: put into the storage box 1 the usual small items commonly used in golf, such as golf tees, divot tools and markers, pencils, oil-based pens, etc., so that it is easy to carry. As shown in FIG. 5, if a player wants to draw a line on the surface of the golf ball 5 temporarily on the golf course, the player can take out the storage box 1, place the golf ball 5 in the box 11, cover the cover 12 slightly, and use the inner wall of the arc-shaped wall 31 in contact with the golf ball 5 to limit the ball's position; and then the player can use an oil-based pen 6 to draw a line on the surface of the golf ball 5 through the line 32 for subsequent confirmation on the rotation direction of the ball after hitting, and for correcting one's own hitting posture or hitting direction. As shown in FIG. 6, the foldable stick 2 is bent into an inverted U-shaped gate, and the storage box 1 is placed on the green for practice, which can be used as the aiming target for putting practice. The mark drawn on the golf ball 5 can also confirm whether the hitting direction is correct, which helps to improve the hitting technique and accuracy.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A multi-functional storage box for golf, comprising: a storage box and a foldable stick, the storage box including a box and a cover able to open and close the box, one end of the foldable stick being pivotally connected to the cover, and the foldable stick being bent to form an inverted U-shaped gate standing adjacent to the cover; the cover having at least one line-drawing portion, and the line-drawing portion comprising an arc-shaped wall and at least a line running through the arc-shaped wall.

2. The multi-functional storage box for golf according to claim 1, wherein a surface of the cover has a strip-shaped storage groove, one end of the storage groove is located at where the foldable stick is pivotally connected to the cover, and the storage groove is for accommodating the foldable stick when the foldable stick is unfolded to become a straight stick.

3. The multi-functional storage box for golf according to claim 1, wherein the foldable stick comprises at least three sticks connected in sequence and can rotate at connecting joints.

4. The multi-functional storage box for golf according to claim 3, wherein the foldable stick comprises a first stick, a second stick, and a third stick, and a size of the second stick is the same as a target hole of the golf ball, and the first stick and the third stick are respectively pivotally connected by two ends of the second stick.

5. The multi-functional storage box for golf according to claim 1, wherein at least one recessed area is formed in a specific area of the cover, and the line-drawing portion is located in the recessed area.

6. The multi-functional storage box for golf according to claim 1, wherein there are three lines and the three lines are parallel to one another.

7. The multi-functional storage box for golf according to claim 1, wherein the line is a cross-shaped slot.

8. A multi-functional storage box for golf, comprising: a storage box and a foldable stick, the storage box comprising a box and a cover for opening and closing the box, one end of the foldable stick being pivotally connected to the cover, the foldable stick comprising at least three sticks connected in sequence and rotatable at connecting joints, the foldable stick being foldable to form an inverted U-shaped gate standing adjacent to the cover.

9. The multi-functional storage box for golf according to claim 8, wherein a surface of the cover has a strip-shaped storage groove, one end of the storage groove is located at where the foldable stick is pivotally connected to the cover, and the storage groove is for accommodating the foldable stick when the foldable stick is unfolded to become a straight stick.

10. The multi-functional storage box for golf according to claim 8, wherein the foldable stick comprises a first stick, a second stick, and a third stick, and a size of the second stick is the same as a target hole of the golf ball, and the first stick and the third stick are respectively pivotally connected by two ends of the second stick.

* * * * *